US011158922B2

(12) United States Patent
Matsumaru

(10) Patent No.: US 11,158,922 B2
(45) Date of Patent: Oct. 26, 2021

(54) TRANSMISSION LINE

(71) Applicant: FUJIKURA LTD., Tokyo (JP)

(72) Inventor: Kohei Matsumaru, Sakura (JP)

(73) Assignee: FUJIKURA LTD., Tokyo (JP)

( * ) Notice: Subject to any disclaimer, the term of this patent is extended or adjusted under 35 U.S.C. 154(b) by 53 days.

(21) Appl. No.: 16/619,509

(22) PCT Filed: Apr. 11, 2018

(86) PCT No.: PCT/JP2018/015237

§ 371 (c)(1),
(2) Date: Dec. 5, 2019

(87) PCT Pub. No.: WO2019/008859

PCT Pub. Date: Jan. 10, 2019

(65) Prior Publication Data

US 2020/0099118 A1 Mar. 26, 2020

(30) Foreign Application Priority Data

Jul. 7, 2017 (JP) ..... JP2017-133964

(51) Int. Cl.
*H01P 5/00* (2006.01)
*H01P 3/08* (2006.01)
(Continued)

(52) U.S. Cl.
CPC ..... *H01P 3/082* (2013.01); *H01P 1/042* (2013.01); *H01P 3/121* (2013.01); *H01P 5/024* (2013.01)

(58) Field of Classification Search
CPC .... H01P 5/08; H01P 5/087; H01P 5/10; H01P 5/082; H01P 5/024; H01P 5/00;
(Continued)

(56) References Cited

U.S. PATENT DOCUMENTS 6,515,562 B1 2/2003 Takenoshita et al.
6,870,438 B1 3/2005 Shino et al.
(Continued)

FOREIGN PATENT DOCUMENTS

JP 2000-077912 A 3/2000
JP 2002-016407 A 1/2002
(Continued)

OTHER PUBLICATIONS

International Search Report dated Jul. 10, 2018, issued in counterpart application No. PCT/JP2018/015237. (2 pages).
(Continued)

*Primary Examiner* — Stephen E. Jones
(74) *Attorney, Agent, or Firm* — Westerman, Hattori, Daniels & Adrian, LLP

(57) ABSTRACT

The present invention reduces the risk of damaging a waveguide made of a brittle material. A transmission line (1) includes: a first waveguide (11) which is made of a brittle material; a second waveguide (21); and a bonding layer (31) by which the first waveguide (11) and the second waveguide (21) are bonded and which is electrically conductive. At least part of the bonding layer (31) is made of an electrically conductive adhesive, the at least part of the bonding layer (31) being in contact with the first waveguide (11).

9 Claims, 4 Drawing Sheets

(51) Int. Cl.
*H01P 3/12* (2006.01)
*H01P 1/04* (2006.01)
*H01P 5/02* (2006.01)

(58) Field of Classification Search
CPC .... H01P 1/04; H01P 1/042; H01P 3/12; H01P 3/121; H01P 3/122
USPC ..... 333/26, 230, 243, 254, 260
See application file for complete search history.

(56) References Cited

U.S. PATENT DOCUMENTS

| | | | | |
|---|---|---|---|---|
| 6,940,361 | B1 | 9/2005 | Jokio et al. | |
| 9,123,979 | B1 | 9/2015 | Izadian | |
| 2004/0145426 | A1 | 7/2004 | Wu et al. | |
| 2014/0147128 | A1* | 5/2014 | Han ..... | H05K 1/142 398/135 |
| 2016/0126637 | A1 | 5/2016 | Uemichi | |

FOREIGN PATENT DOCUMENTS

| | | | |
|---|---|---|---|
| JP | 2002-185203 | A | 6/2002 |
| JP | 2004-511155 | A | 4/2004 |
| JP | 4181085 | B2 | 11/2008 |
| JP | 2010-081486 | A | 4/2010 |
| JP | 2016-127378 | A | 7/2016 |
| WO | 2015/162992 | A1 | 10/2015 |

OTHER PUBLICATIONS

With English Translation of Notification of Transmittal of Translation of the International Preliminary Report on Patentability (Form PCT/IB/338) of International Application No. PCT/JP2018/015237 dated Jan. 16, 2020 with Forms PCT/IB/373 and PCT/ISA/237. (9 pages).

* cited by examiner

TRANSMISSION LINE

TECHNICAL FIELD

The present invention relates to a transmission line including a waveguide that is made of a brittle material.

BACKGROUND ART

A dielectric waveguide, in which a conductor layer is provided on each of the front and back surfaces of a dielectric substrate, is advantageous in that it is suitable for transmission of millimeter waves and it can be thin in thickness. Examples of such a dielectric waveguide include the dielectric waveguide tube antenna disclosed in Patent Literature 1. As a material for a substrate of a dielectric waveguide, quartz glass is promising because quartz glass has a small dielectric dissipation factor and therefore allows a reduction in dielectric loss (see Patent Literature 2).

Examples of a method for joining dielectric waveguides that constitute a transmission line include screwing, soldering, and brazing (see Patent Literature 3).

CITATION LIST

Patent Literature

[Patent Literature 1]
Japanese Patent No. 4181085
[Patent Literature 2] Japanese Patent Application Publication Tokukai No. 2014-265643
[Patent Literature 3]
Japanese Patent Application Publication Tokukai No. 2002-185203

SUMMARY OF INVENTION

Technical Problem

However, the following issues arise in a case where a conventional transmission line which includes two waveguides joined to each other is configured so that at least one of the two waveguides is made of a brittle material such as quartz glass. Note that the at least one of the two waveguides will be hereinafter referred to as "first waveguide".

The first issue arises in a case where the two waveguides are joined by screwing. In order to join two waveguides by screwing, it is necessary to make screw holes in each of the two waveguides. However, in a case where screw holes are made in the first waveguide, mechanical strength of the first waveguide decreases. Furthermore, the first waveguide is highly likely to be (i) damaged while screw holes are being made and/or (ii) damaged, after screw holes have been made, due to a scratch made while the screw holes were being made.

The second issue arises in a case where the two waveguides are joined by soldering or brazing. In a case where the two waveguides are joined by soldering, the respective temperatures of the two waveguides increase while solder is being melted, and the respective temperatures of the two waveguides decrease while solder is being cured. Stress is therefore applied to the first waveguide due to a difference in thermal expansion between the first waveguide and the second waveguide. Furthermore, stress is applied to the first waveguide also during solidification shrinkage of solder. These stresses are highly likely to damage the first waveguide. The same issue arises in a case where the two waveguides are joined by brazing.

The present invention was attained in view of the above issues, and an object of the present invention is to provide a transmission line in which a waveguide made of a brittle material is unlikely to be damaged.

Solution to Problem

A transmission line in accordance with an aspect of the present invention includes: a first waveguide which is made of a brittle material; a second waveguide; and a bonding layer by which the first waveguide and the second waveguide are bonded and which is electrically conductive, at least part of the bonding layer being made of an electrically conductive adhesive, the at least part of the bonding layer being in contact with the first waveguide.

Advantageous Effects of Invention

An aspect of the present invention makes it possible to provide a transmission line in which a waveguide made of a brittle material is unlikely to be damaged.

Figure 1:
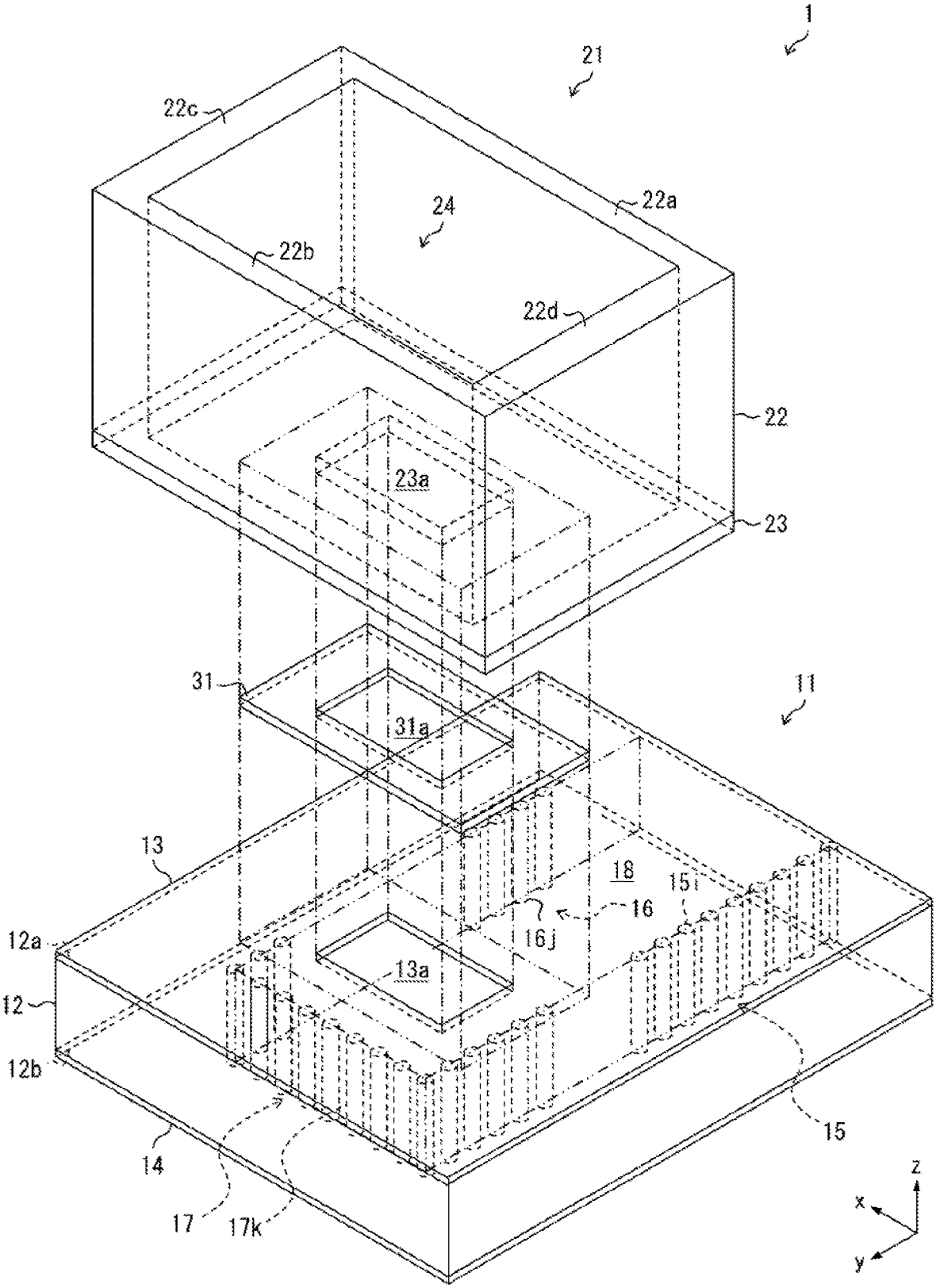
FIG. 1 is an exploded perspective view of a transmission line in accordance with Embodiment 1 of the present invention.
Figure 2:
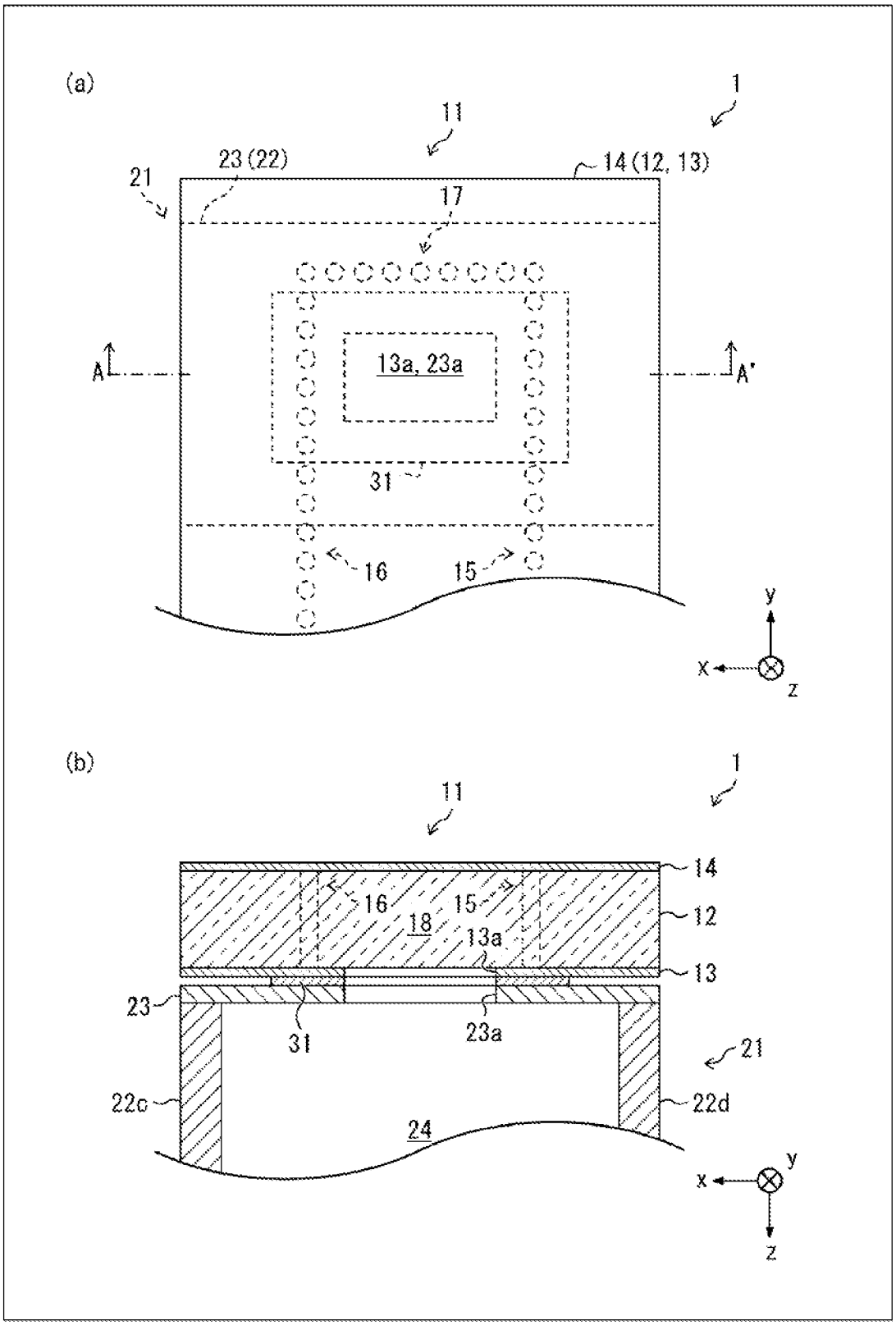

(a) of FIG. 2 is a plan view of the transmission line shown in FIG. 1. (b) of FIG. 2 is a cross-sectional view of the transmission line shown in FIG. 1.

Figure 3:
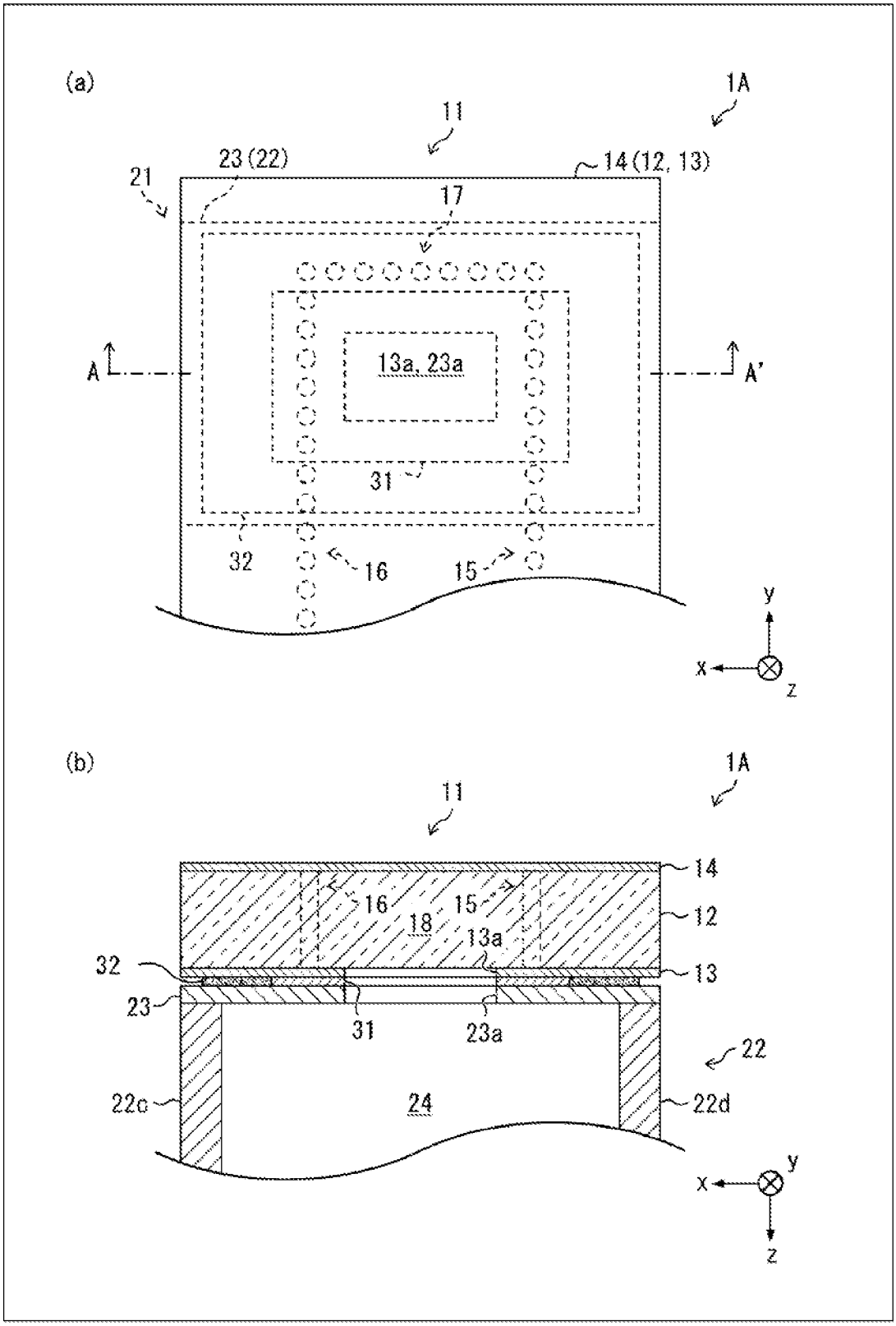

(a) of FIG. 3 is a plan view of Variation 1 of the transmission line shown in FIG. 1. (b) of FIG. 3 is a cross-sectional view of the transmission line shown in (a) of FIG. 3.

Figure 4:
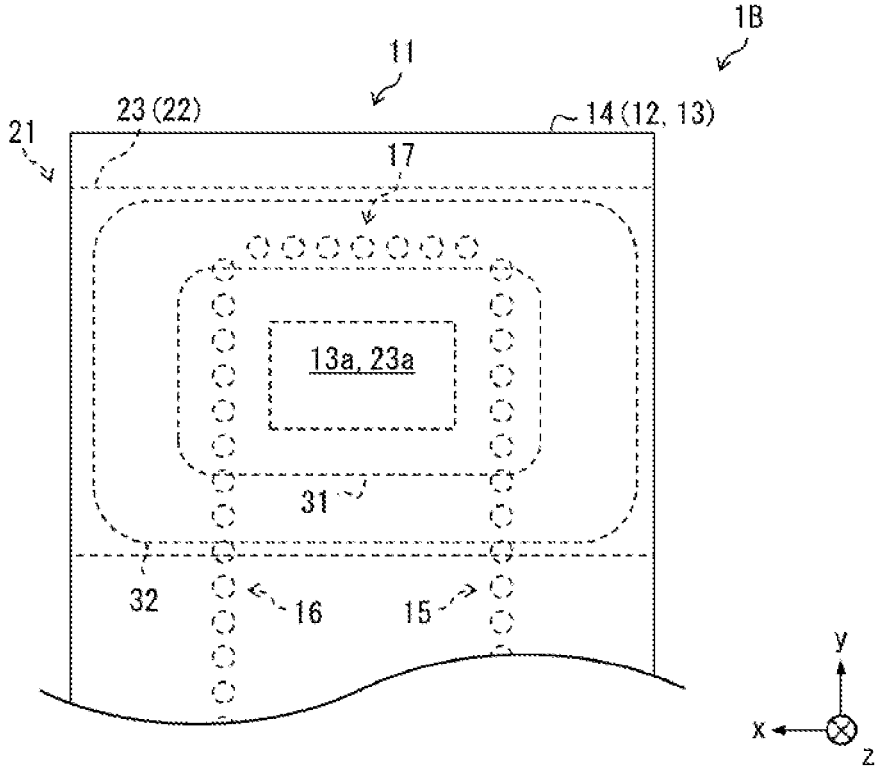

FIG. 4 is a plan view of Variation 2 of the transmission line shown in FIG. 1.

Figure 5:
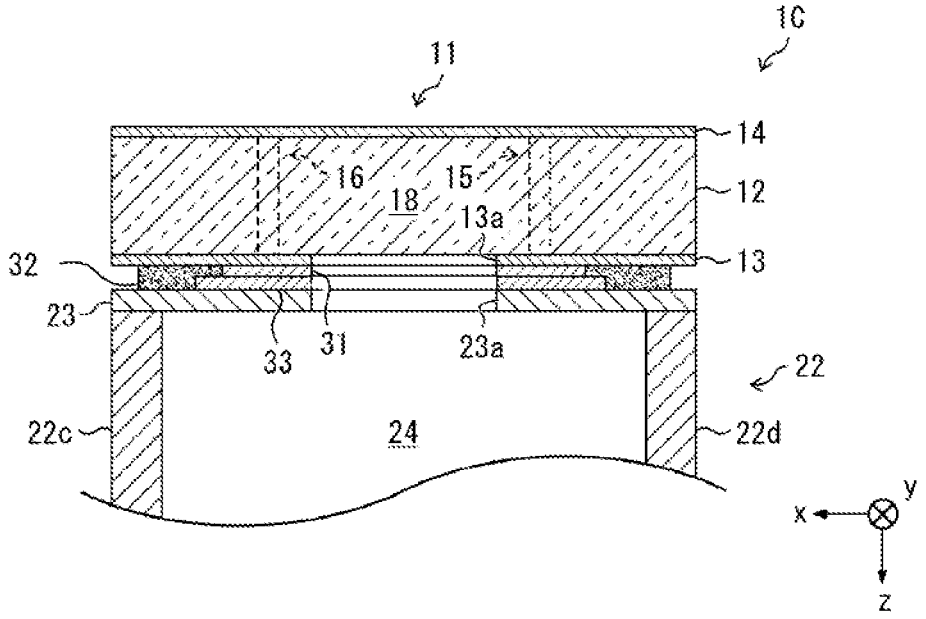

FIG. 5 is a cross-sectional view of Variation 3 of the transmission line shown in FIG. 1.

DESCRIPTION OF EMBODIMENTS

[Configuration of Transmission Line]

The following description will discuss, with reference to FIGS. 1 and 2, a transmission line in accordance with an embodiment of the present invention. FIG. 1 is an exploded perspective view of a transmission line 1 in accordance with the present embodiment. (a) of FIG. 2 is a plan view of the transmission line 1 shown in FIG. 1. (b) of FIG. 2 is a cross-sectional view of the transmission line 1 shown in FIG. 1, the cross-sectional view being taken along the A-A' line shown in (a) of FIG. 2. Note that the coordinate system shown in FIGS. 1 and 2 is set so that (i) the y-axis positive direction matches a direction in which an electromagnetic wave is to be guided through a post-wall waveguide 11 and (ii) the z-axis positive direction matches a direction in which the electromagnetic wave is then guided through a waveguide tube 21. The x-axis positive direction of the coordinate system is set so as to constitute, together with the y-axis positive direction and the z-axis positive direction defined as described above, a right-handed coordinate system.

Hereinafter, a post-wall waveguide will be abbreviated as "PWW".

The transmission line 1 is a transmission line that is suitable for transmission of millimeter waves. The transmission line 1 includes the post-wall waveguide 11 (corresponding to a "first waveguide" recited in the claims), the waveguide tube 21 (corresponding to a "second waveguide" recited in the claims), and a bonding layer 31 by which the post-wall waveguide 11 and the waveguide tube 21 are bonded. A post-wall waveguide, whose narrow walls are each constituted by a post wall, is advantageous in that a lighter weight can be achieved in comparison with a dielectric waveguide, whose narrow walls are each constituted by a conductor plate.

(PWW 11)

The PWW 11 includes (i) a substrate 12 (corresponding to a "dielectric substrate" recited in the claims), (ii) a first conductor layer 13 which is provided on a first main surface 12*a* of the substrate 12, and (iii) a second conductor layer 14 which is provided on a second main surface 12*b* of the substrate 12. Each of the first conductor layer 13 and the second conductor layer 14 serves as a wide wall of the PWW 11.

The substrate 12 is made of a dielectric brittle material. Examples of such a brittle material, of which the substrate 12 is made, include glass (e.g., quartz glass) and ceramic. According to the present embodiment, the brittle material, of which the substrate 12 is made, is quartz glass (thermal expansion coefficient: $0.5\times10^{-6}$/K, elastic modulus: 73 GPa).

The substrate 12 includes post walls 15, 16, and 17. The post wall 15 is constituted by a plurality of conductor posts 15*i* which are arranged in a fence-like manner. Note here that "i" is a natural number that satisfies $1\leq i\leq L$ ("L" is a natural number that represents the number of the conductor posts 15*i*). Each of the plurality of conductor posts 15*i* is obtained by (i) making a via that passes through the substrate 12 from the first main surface 12*a* to the second main surface 12*b*, and then (ii) filling the via with an electric conductor such as metal or depositing such an electric conductor on the inner wall of the via. In a case where the plurality of conductor posts 15*i* are arranged at intervals each sufficiently smaller than a wavelength of an electromagnetic wave to be guided through the PWW 11, the post wall 15 serves as a reflection wall. Similarly to the post wall 15, the post wall 16 is constituted by a plurality of conductor posts 16*j*, the post wall 17 is constituted by a plurality of conductor posts 17*k*, and each of the post walls 16 and 17 serves as a narrow wall of the PWW 11. Note here that "j" is a natural number that satisfies $1\leq j\leq M$ ("M" is a natural number that represents the number of the conductor posts 16*j*), and "k" is a natural number that satisfies $1\leq k\leq N$ ("N" is a natural number that represents the number of the conductor posts 17*k*).

In FIG. 1, the narrow walls achieved by the respective post walls 15, 16, and 17 are indicated by imaginary lines (two-dot chain lines). In FIG. 1, some parts of the post walls 15 and 16 are not illustrated so that the configuration between the PWW and the waveguide tube (described later) can be easily viewed.

The substrate 12 has a rectangular-parallelepiped region that is surrounded by the conductor layers 13 and 14 and the post walls 15 through 17. This rectangular-parallelepiped region serves as a propagation region 18 through which an electromagnetic wave propagates. In the propagation region 18, an electromagnetic wave propagates along the y-axis of the coordinate system shown in FIG. 1.

The conductor layer 13 has an opening 13*a* which is provided in the vicinity of one end portion of the propagation region 18 so as to serve as the entrance and the exit of the propagation region 18. The opening 13*a* has a rectangular shape, and is oriented such that long sides of the opening 13*a* are orthogonal to the lengthwise direction of the propagation region 18 (i.e., orthogonal to the y-axis direction shown in FIG. 1).

(Waveguide Tube 21)

The waveguide tube 21 is a quadrangular waveguide tube including a tube wall 22 which is constituted by (i) a pair of wide walls 22*a* and 22*b* and (ii) a pair of narrow walls 22*c* and 22*d*. One end of the waveguide tube 21 is closed with a short wall 23. The short wall 23 has an opening 23*a* which is identical in shape to the opening 13*a* of the PWW H. The waveguide tube 21 can either be hollow or be filled with a dielectric that is different from air.

The waveguide tube 21 (i.e., the tube wall 22 and the short wall 23) is made of a conductor material. Examples of the conductor material, of which the waveguide tube 21 is made, include copper and brass. According to the present embodiment, the conductor material, of which the waveguide tube 21 is made, is copper (thermal expansion coefficient: $16.8\times10^{-6}$/K, elastic modulus: 129 GPa).

The four sides of the tube wall 22 form a rectangular-parallelepiped region therein. The rectangular-parallelepiped region serves as a propagation region 24 through which an electromagnetic wave propagates. In the propagation region 24, an electromagnetic wave propagates along the z-axis of the coordinate system shown in FIG. 1.

The waveguide tube 21 is arranged such that (i) the short wall 23 faces the conductor layer 13 of the PWW 11 and (ii) the opening 23*a* of the short wall 23 overlaps the opening 13*a* of the conductor layer 13. The propagation region 24 of the waveguide tube 21 communicates with the propagation region 18 of the PWW 11 via the opening 23*a* and the opening 13*a*. That is, a waveguide mode of the waveguide tube 21 is coupled to that of the PWW 11 via the opening 23*a* and the opening 13*a*.

(Bonding Layer 31)

The bonding layer 31 is provided between the conductor layer 13 of the PWW 11 and the short wall 23 of the waveguide tube 21 so as to bond the PWW 11 and the waveguide tube 21. The bonding layer 31 is made of an electrically conductive adhesive which has, after being cured, an elastic modulus smaller than that of the brittle material (in the present embodiment, quartz glass) of which the PWW 11 is made. Examples of the electrically conductive adhesive include: a silver paste obtained by adding a silver filler to a resin; and a copper paste obtained by adding a copper filler to a resin.

According to the present embodiment, the bonding layer 31 is obtained by applying a silver paste (thermal expansion coefficient: $30\times10^{-6}$/K to $50\times10^{-6}$/K, elastic modulus after curing: 5 GPa) to a surface of the conductor layer 13 of the PWW 11 so as to surround the opening 13*a*, and then curing the silver paste. The silver paste can be applied by use of any conventional technique, examples of which include (i) a method in which a dispenser is used, (ii) a transfer printing method, and (iii) a printing method.

According to the transmission line 1 in accordance with the present embodiment, it is unnecessary to join the PWW 11 and the waveguide tube 21 with use of a screw(s) because the PWW 11 and the waveguide tube 21 are bonded by the bonding layer 31. This eliminates the need for making screw holes in the PWW 11. The PWW 11 is therefore less likely to be (i) damaged while screw holes are being made and/or (ii) damaged, after screw holes have been made, due to a scratch made while the screw holes were being made.

Since the bonding layer 31 is electrically conductive, it is possible to short-circuit the PWW 11 and the waveguide tube 21 even though the PWW 11 and the waveguide tube 21 are not joined with use of screws. Furthermore, since the bonding layer 31 has an elastic modulus smaller than that of the brittle material of which the PWW 11 is made, it is possible to reduce stress that is applied to the PWW 11 due to a difference in thermal expansion between the PWW 11 and the waveguide tube 21. Furthermore, since the bonding layer 31 having an electrical conductivity surrounds the opening 13*a* of the PWW 11 and the opening 23*a* of the waveguide tube 21, it is possible to inhibit electromagnetic wave leakage that may occur at a gap between the PWW 11 and the waveguide tube 21.

[Variation 1]

The following description will discuss Variation 1 of the transmission line 1 with reference to FIG. 3. (a) of FIG. 3 is a plan view of a transmission line 1A in accordance with Variation 1. (b) of FIG. 3 is a cross-sectional view of the transmission line 1A in accordance with Variation 1, the cross-sectional view being taken along the A-A' line shown in (a) of FIG. 3.

The transmission line 1A in accordance with Variation is obtained by adding a bonding layer 32 to the transmission line 1 shown in FIGS. 1 and 2. Similarly to a bonding layer 31, the bonding layer 32 is provided between a conductor layer 13 of a PWW 11 and a short wall 23 of a waveguide tube 21 so as to bond the PWW 11 and the waveguide tube 21. Therefore, according to the transmission line 1A in accordance with Variation 1, the PWW 11 and the waveguide tube 21 are bonded by not only the bonding layer 31 but also the bonding layer 32. Note here that the bonding layer 31 corresponds to a "bonding layer" recited in the claims, and the bonding layer 32 corresponds to "another bonding layer" recited in the claims.

The bonding layer 32 is made of a non-electrically conductive adhesive which has, after being cured, an elastic modulus smaller than that of the brittle material (in the present embodiment, quartz glass) of which the PWW 11 is made. Examples of the non-electrically conductive adhesive, of which the bonding layer 32 is made, include acrylic resins, silicone resins, and epoxy resins. According to the present embodiment, the bonding layer 32 is obtained by applying epoxy resin (thermal expansion coefficient: $30\times10^{-6}$/K to $50\times10^{-6}$/K, elastic modulus after curing: 2 GPa to 5 GPa) to a surface of the conductor layer 13 of the PWW 11 so as to surround the bonding layer 31, and then curing the epoxy resin.

The non-electrically conductive adhesive can be applied by, for example, a method in which, after the waveguide tube 21 and the PWW 11 are bonded by the bonding layer 31 (i.e., after the electrically conductive adhesive for the bonding layer 31 is cured), a gap between the PWW 11 and the waveguide tube 21 is filled with the non-electrically conductive adhesive by use of a capillary flow technology. The non-electrically conductive adhesive thus applied is less likely to enter (i) a gap between the PWW 11 and the electrically conductive adhesive or (ii) a gap between the waveguide tube 21 and the electrically conductive adhesive. The conduction between the PWW 11 and the waveguide tube 21 is therefore less likely to be disturbed.

According to the transmission line 1, the PWW 11 and the waveguide tube 21 are bonded by the bonding layer 31 alone. In contrast, according to the transmission line 1A in accordance with Variation 1, the PWW 11 and the waveguide tube 21 are bonded by not only the bonding layer 31 but also the bonding layer 32. This increases an area in which the PWW 11 and the waveguide tube 21 are bonded, and therefore enhances the strength by which the PWW 11 and the waveguide tube 21 are bonded. Furthermore, according to the transmission line 1A in accordance with Variation 1, stress that is concentrated on the bonding layer 31 of the transmission line 1 is distributed not only to the bonding layer 31 but also to the bonding layer 32. The bonding layer 31 of the transmission line 1A in accordance with Variation is therefore less likely to break due to the stress. Furthermore, the bonding layer 31 of the transmission line 1 is exposed to an external environment. In contrast, the bonding layer 31 of the transmission line 1A is not exposed to an external environment. The transmission line 1A in accordance with Variation 1 can therefore inhibit deterioration of the bonding layer 31, which deterioration may occur due to exposure to the external environment. Examples of such deterioration include (i) corrosion due to moisture absorption and (ii) conduction failure due to migration.

Variation 1 was discussed with an example in which an outer periphery of the bonding layer 31 is entirely in contact with an inner periphery of the bonding layer 32. However, it is alternatively possible that the outer periphery of the bonding layer 31 is partially or entirely spaced from the inner periphery of the bonding layer 32.

[Variation 2]

The following description will discuss Variation 2 of the transmission line 1 with reference to FIG. 4. FIG. 4 is a plan view of a transmission line 1B in accordance with Variation 2.

The transmission line 1B in accordance with Variation 2 is obtained by deforming the respective outer peripheries of the bonding layers 31 and 32 of the transmission line 1A shown in FIG. 3. According to the transmission line 1A, each of the bonding layers 31 and 32 has an angular outer periphery (specifically, a rectangular outer periphery). In contrast, according to the transmission line 1B, each of bonding layers 31 and 32 has an outer periphery whose corners are rounded (specifically, a rectangular outer periphery whose corners are rounded).

According to the transmission line 1A in accordance with Variation 1, stress is likely to be concentrated on the four corners of each of the bonding layers 31 and 32. In contrast, according to the transmission line 1B in accordance with Variation 2, stress is less likely to be concentrated on the four corners of each of the bonding layers 31 and 32. The bonding layers 31 and 32 of the transmission line 1B in accordance with Variation 2 are therefore less likely to break due to concentration of stress.

[Variation 3]

The following description will discuss Variation 3 of the transmission line 1 with reference to FIG. 5. FIG. 5 is a cross-sectional view of a transmission line 1C in accordance with Variation 3.

The transmission line 1C in accordance with Variation 3 is obtained by adding a solder layer 33 to the transmission line 1A shown in FIG. 3. The solder layer 33 is provided on a short wall 23 of a waveguide tube 21 so as to surround an opening 23*a*. According to Variation 3, the solder layer 33 is made of AuSn90 solder (thermal expansion coefficient: $13.6^{-6}$/K, elastic modulus: 40 GPa). A bonding layer 31 is provided on a conductor layer 13 of a PWW 11, so as to surround an opening 13*a*. A bonding layer 32 is provided between the conductor layer 13 of the PWW 11 and the short wall 23 of the waveguide tube 21, so as to surround the bonding layer 31 and the solder layer 33.

According to the transmission line 1C in accordance with Variation 3, a space between the opening 13*a* of the PWW 11 and the opening 23*a* of the waveguide tube 21 is surrounded by the bonding layer 31 and the solder layer 33 each of which is electrically conductive. This makes it possible to inhibit electromagnetic wave leakage that may occur at a gap between the PWW 11 and the waveguide tube 21.

According to Variation 3, (i) an outer periphery of the bonding layer 31 can be partially or entirely spaced from an inner periphery of the bonding layer 32 and/or (ii) an outer periphery of the solder layer 33 can be partially or entirely spaced from an inner periphery of the bonding layer 32.

Aspects of the present invention can also be expressed as follows: A transmission line (1, 1A, 1B, or 1C) in accordance with the present embodiment includes: a first waveguide (11) which is made of a brittle material; a second waveguide (21); and a bonding layer (31) by which the first waveguide (11) and the second waveguide (21) are bonded and which is electrically conductive, at least part of the bonding layer (31) being made of an electrically conductive adhesive, the at least part of the bonding layer (31) being in contact with the first waveguide (11).

According to the above configuration, the first waveguide and the second waveguide are bonded by the bonding layer. This eliminates the need for joining the first waveguide and the second waveguide together by screwing, soldering, or brazing. It is therefore possible to reduce the risk that the first waveguide made of a brittle material will be damaged due to the process of screwing, soldering, or brazing for joining the first waveguide and the second waveguide.

According to the above configuration, the bonding layer is electrically conductive. This makes it possible to short-circuit the first waveguide and the second waveguide even though the first waveguide and the second waveguide are not joined with use of screws or the like.

The transmission line (1, 1A, 1B, or 1C) in accordance with the present embodiment is preferably configured such that the electrically conductive adhesive has, after being cured, an elastic modulus smaller than that of the brittle material.

According to the above configuration, the bonding layer has an elastic modulus smaller than that of the brittle material of which the first waveguide is made. This makes it possible to reduce stress that is applied to the first waveguide due to a difference in thermal expansion between the first waveguide and the second waveguide. It is therefore possible to reduce the risk that the first waveguide will be damaged due to stress applied to the first waveguide.

The transmission line (1, 1A, 1B, or 1C) in accordance with the present embodiment is preferably configured such that a waveguide mode of the first waveguide (11) is coupled to that of the second waveguide (21) via respective openings (13*a* and 23*a*) of the first waveguide (11) and of the second waveguide (21); and the bonding layer (31) surrounds the respective openings (13*a* and 23*a*) of the first waveguide and of the second waveguide.

According to the above configuration, the openings via which the waveguide mode of the first waveguide is coupled to that of the second waveguide are surrounded by the bonding layer made of an electrically conductive adhesive. It is therefore possible to inhibit electromagnetic wave leakage that may occur at a gap between the first waveguide and the second waveguide.

The transmission line (1, 1A, 1B, or 1C) in accordance with the present embodiment is preferably configured such that the bonding layer (31) has an outer periphery whose corners are rounded.

The above configuration makes it possible to reduce the risk that the bonding layer will break due to concentration of stress.

The transmission line (1A, 1B, or 1C) in accordance with the present embodiment is preferably configured to further include: another bonding layer (32) which is provided so as to surround the bonding layer (31) and which is made of a non-electrically conductive adhesive, the first waveguide (11) and the second waveguide (21) being bonded by not only the bonding layer (31) but also the another bonding layer (32).

According to the above configuration, the first waveguide and the second waveguide are bonded by not only the bonding layer made of an electrically conductive adhesive but also the another bonding layer made of a non-electrically conductive adhesive. This increases an area in which the first waveguide and the second waveguide are bonded, and therefore enhances the strength by which the first waveguide and the second waveguide are bonded. The above configuration also makes it possible to distribute, to the another bonding layer, stress that is concentrated on the bonding layer. The bonding layer is therefore less likely to break due to the stress. Furthermore, since the bonding layer is surrounded by the another bonding layer, the bonding layer is no longer exposed to an external environment. It is therefore possible to inhibit deterioration (e.g., corrosion or the like) of the bonding layer, which deterioration may occur due to exposure to the external environment.

The transmission line (1A, 1B, or 1C) in accordance with the present embodiment is preferably configured such that the non-electrically conductive adhesive has, after being cured, an elastic modulus smaller than that of the brittle material.

According to the above configuration, the another bonding layer has an elastic modulus smaller than that of the brittle material of which the first waveguide is made. This makes it possible to reduce stress that is applied to the first waveguide due to a difference in thermal expansion between the first waveguide and the second waveguide. It is therefore possible to reduce the risk that the first waveguide will be damaged due to stress applied to the first waveguide.

The transmission line (1B or 1C) in accordance with the present embodiment is preferably configured such that the another bonding layer (32) has an outer periphery whose corners are rounded.

The above configuration makes it possible to reduce the risk that the another bonding layer will break due to concentration of stress.

The transmission line (1, 1A, 1B, or 1C) in accordance with the present embodiment is preferably configured such that the first waveguide (11) is a waveguide including (1) a dielectric substrate (12) which is made of the brittle material, (2) a first conductor layer (13) which is provided on a first main surface (12*a*) of the dielectric substrate (12), (3) a second conductor layer (14) which is provided on a second main surface (12*b*) of the dielectric substrate (12), and (4) at least one post wall (15 through 17) which is provided in the dielectric substrate (12); the first conductor layer (13) and the second conductor layer (14) each serve as a wide wall of the waveguide; and the at least one post wall (15 through 17) serves as a narrow wall of the waveguide.

The above configuration makes it possible to produce the first waveguide that is thin and lightweight.

The transmission line (1, 1A, 1B, or 1C) in accordance with the present embodiment is preferably configured such that the brittle material is quartz glass.

The above configuration allows a reduction in dielectric loss of the first waveguide.

Supplemental Note

The present invention is not limited to the foregoing embodiment, but can be altered by a skilled person in the art within the scope of the claims. The present invention also encompasses, in its technical scope, any embodiment derived by combining technical means disclosed in the foregoing embodiment and its variations.

REFERENCE SIGNS LIST

1, 1A, 1B, 1C: Transmission line
11: Post-wall waveguide (first waveguide)
12: Substrate
12*a*: First main surface
12*b*: Second main surface
13: Conductor layer (first conductor layer)
13*a*: Opening
14: Conductor layer (second conductor layer)
15, 16, 17: Post wall
18: Propagation region
21: Waveguide tube (second waveguide)
22: Tube wall
23: Short wall
23*a*: Opening
24: Propagation region
31: Bonding layer (electrically conductive adhesive)
32: Bonding layer (non-electrically conductive adhesive)
33: Solder layer

The invention claimed is:

1. A transmission line, comprising:
a first waveguide which is made of a brittle material;
a second waveguide; and
a bonding layer by which the first waveguide and the second waveguide are bonded and which is electrically conductive,
at least part of the bonding layer being made of an electrically conductive adhesive, the at least part of the bonding layer being in contact with the first waveguide,
wherein the bonding layer has an outer periphery whose corners are rounded.

2. The transmission line as set forth in claim 1, wherein the electrically conductive adhesive has, after being cured, an elastic modulus smaller than that of the brittle material.

3. The transmission line as set forth in claim 1, wherein:
the first waveguide is a waveguide including (1) a dielectric substrate which is made of the brittle material, (2) a first conductor layer which is provided on a first main surface of the dielectric substrate, (3) a second conductor layer which is provided on a second main surface of the dielectric substrate, and (4) at least one post wall which is provided in the dielectric substrate;
the first conductor layer and the second conductor layer each serve as a wide wall of the waveguide; and
the at least one post wall serves as a narrow wall of the waveguide.

4. The transmission line as set forth in claim 1, wherein the brittle material is quartz glass.

5. The transmission line as set forth in claim 1, wherein:
a waveguide mode of the first waveguide is coupled to that of the second waveguide via respective openings of the first waveguide and of the second waveguide; and
the bonding layer surrounds the respective openings of the first waveguide and of the second waveguide.

6. The transmission line as set forth in claim 5, wherein the respective openings have a rectangular shape.

7. The transmission line as set forth in claim 1, further comprising:
another bonding layer which is provided so as to surround the bonding layer and which is made of a non-electrically conductive adhesive,
the first waveguide and the second waveguide being bonded by not only the bonding layer but also the another bonding layer.

8. The transmission line as set forth in claim 7, wherein the non-electrically conductive adhesive has, after being cured, an elastic modulus smaller than that of the brittle material.

9. The transmission line as set forth in claim 7, wherein the another bonding layer has an outer periphery whose corners are rounded.

* * * * *